US007780140B1

(12) United States Patent
Ward et al.

(10) Patent No.: US 7,780,140 B1
(45) Date of Patent: Aug. 24, 2010

(54) TWO-PIECE PLASTIC EQUIPMENT PAD

(75) Inventors: Charles Barry Ward, Alpharetta, GA (US); Kenneth Bertoli, Canton, GA (US); Keith Platt, Snellville, GA (US)

(73) Assignee: Diversitech Corporation, Duluth, GA (US)

( * ) Notice: Subject to any disclaimer, the term of this patent is extended or adjusted under 35 U.S.C. 154(b) by 0 days.

(21) Appl. No.: 12/364,260

(22) Filed: Feb. 2, 2009

Related U.S. Application Data

(60) Provisional application No. 61/028,621, filed on Feb. 14, 2008.

(51) Int. Cl.
*F16M 3/00* (2006.01)

(52) U.S. Cl. ..... 248/678

(58) Field of Classification Search ..... 108/901, 108/57.25, 51.11; 248/678, 346.01, 346.02
See application file for complete search history.

(56) References Cited

U.S. PATENT DOCUMENTS

| | | | | |
|---|---|---|---|---|
| 1,363,152 | A | 12/1920 | Murray, Jr. et al. | |
| 3,258,236 | A | 6/1966 | Moritz | |
| 3,317,069 | A | 5/1967 | Chin | |
| 3,713,620 | A * | 1/1973 | Tkach | 248/678 |
| D309,308 | S | 7/1990 | Webb | |
| D313,418 | S | 1/1991 | Webb | |
| D322,970 | S | 1/1992 | Webb | |
| 5,197,396 | A * | 3/1993 | Breezer et al. | 108/56.3 |
| 5,505,141 | A * | 4/1996 | Barber | 108/57.26 |
| D404,992 | S | 2/1999 | Sittig | |
| 5,878,984 | A | 3/1999 | Grieser et al. | |
| D423,340 | S | 4/2000 | Sittig | |
| 6,053,466 | A * | 4/2000 | Jordan et al. | 248/346.01 |
| 6,135,410 | A | 10/2000 | Harrison | |
| 6,186,468 | B1 * | 2/2001 | Schlegel | 248/678 |
| D493,095 | S | 7/2004 | Sittig | |
| D493,096 | S | 7/2004 | Sittig | |
| 6,923,419 | B2 | 8/2005 | George et al. | |
| D550,069 | S | 9/2007 | Milligen | |
| D555,569 | S | 11/2007 | Buettner | |
| D560,260 | S | 1/2008 | Flentye et al. | |
| 7,334,421 | B1 | 2/2008 | Cantolino | |
| 2002/0134284 | A1 * | 9/2002 | Apps | 108/57.25 |
| 2003/0047658 | A1 | 3/2003 | Peter et al. | |
| 2003/0183741 | A1 | 10/2003 | Milner | |
| 2004/0262485 | A1 * | 12/2004 | Marceau et al. | 248/346.01 |
| 2005/0035267 | A1 | 2/2005 | Stansbury | |
| 2007/0090234 | A1 | 4/2007 | Liao | |
| 2007/0187564 | A1 | 8/2007 | McGuire | |
| 2007/0235616 | A1 | 10/2007 | Gross et al. | |
| 2008/0135693 | A1 | 6/2008 | Naprano | |
| 2008/0236455 | A1 * | 10/2008 | Naidu | 108/56.1 |
| 2009/0090835 | A1 | 4/2009 | Harrison | |
| 2009/0179122 | A1 | 7/2009 | Inzero | |
| 2009/0212177 | A1 | 8/2009 | Beasley | |

* cited by examiner

*Primary Examiner*—Ramon O Ramirez
(74) *Attorney, Agent, or Firm*—Smith Gambrell & Russell LLP

(57) ABSTRACT

A two-piece plastic equipment pad with a top portion and an identical bottom portion. Each portion has a base with an underlying grid structure comprising cells formed by perpendicular ribs. The top portion and the bottom portion are aligned and connected together by connector strips that slots formed in the perpendicular ribs of the grid structure of the top portion and the bottom portion.

16 Claims, 8 Drawing Sheets

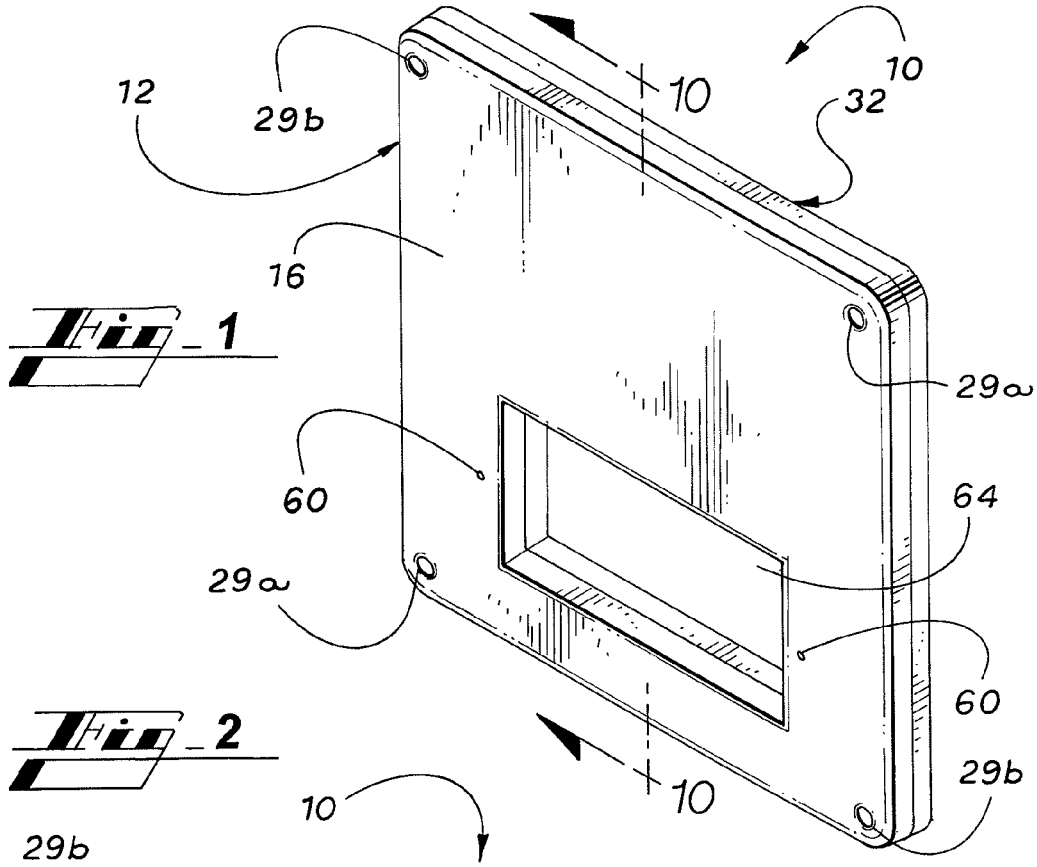
Fig_1
Fig_2
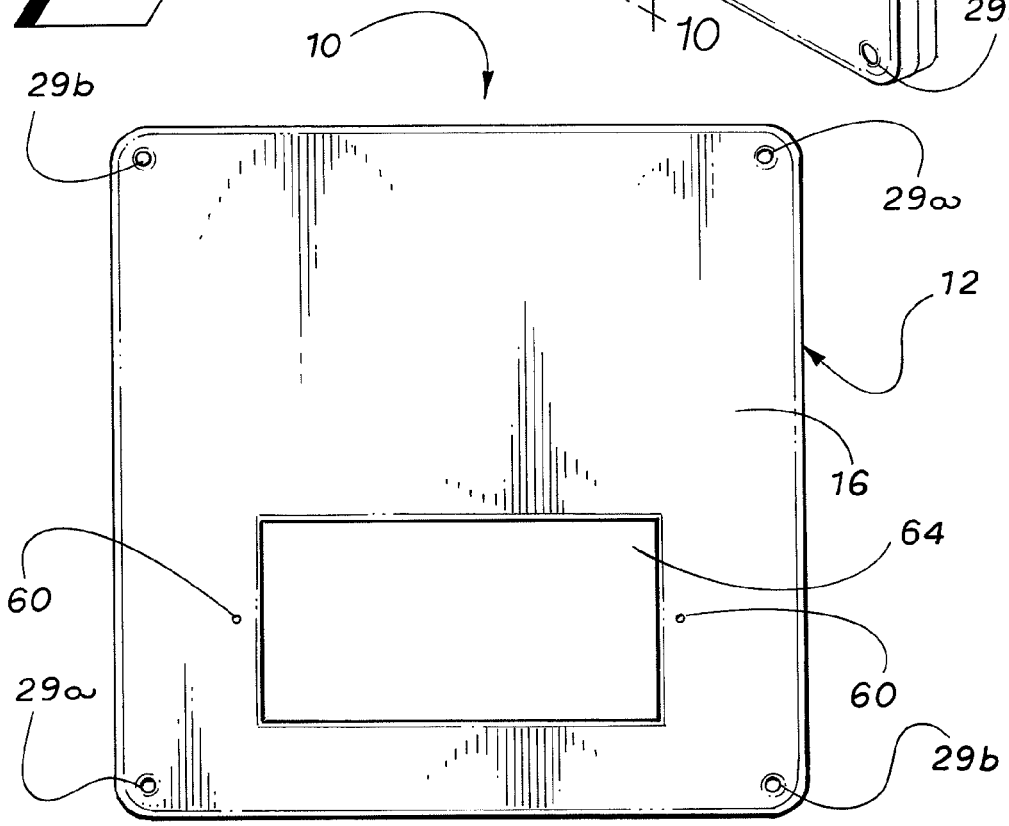

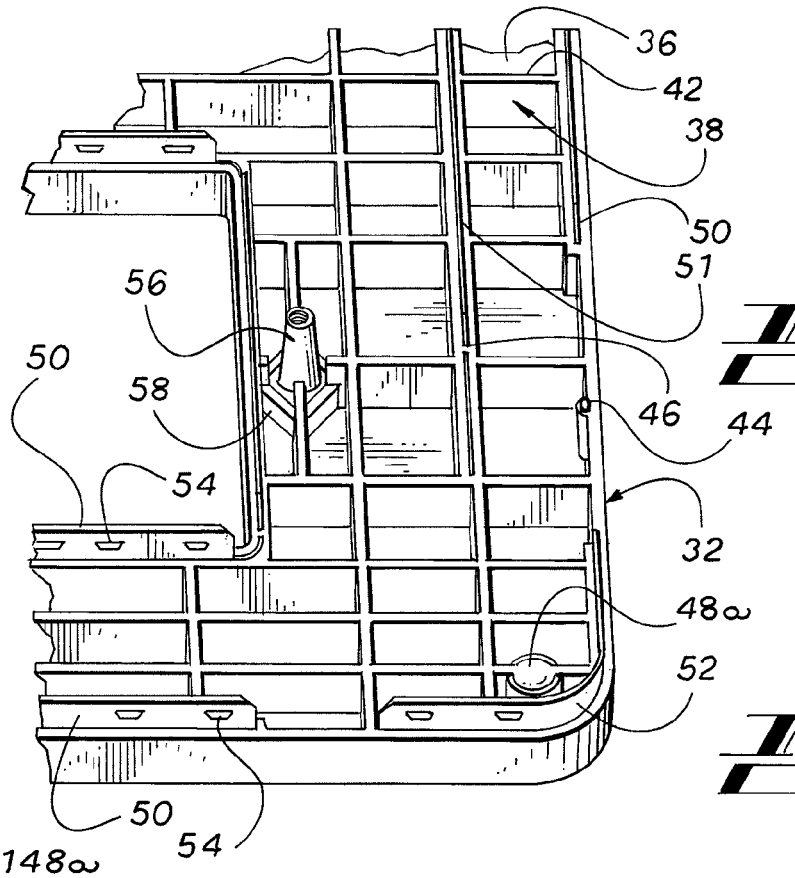
Fig. 8
Fig. 14
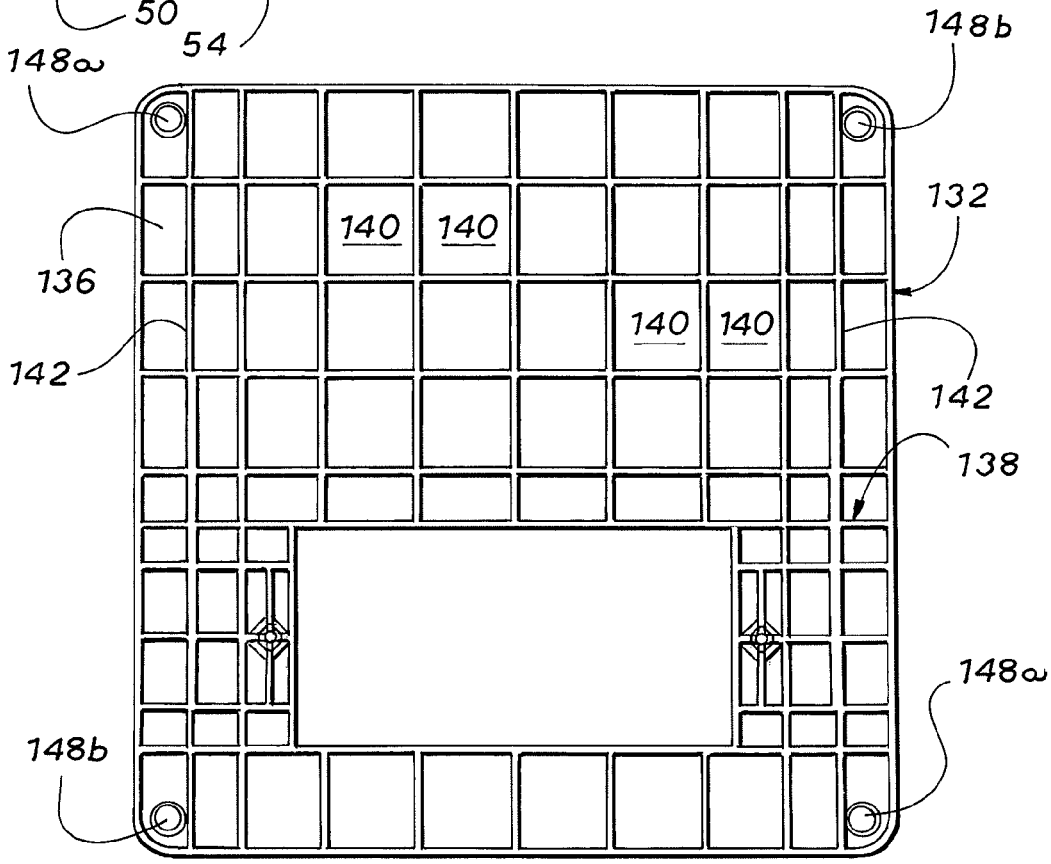

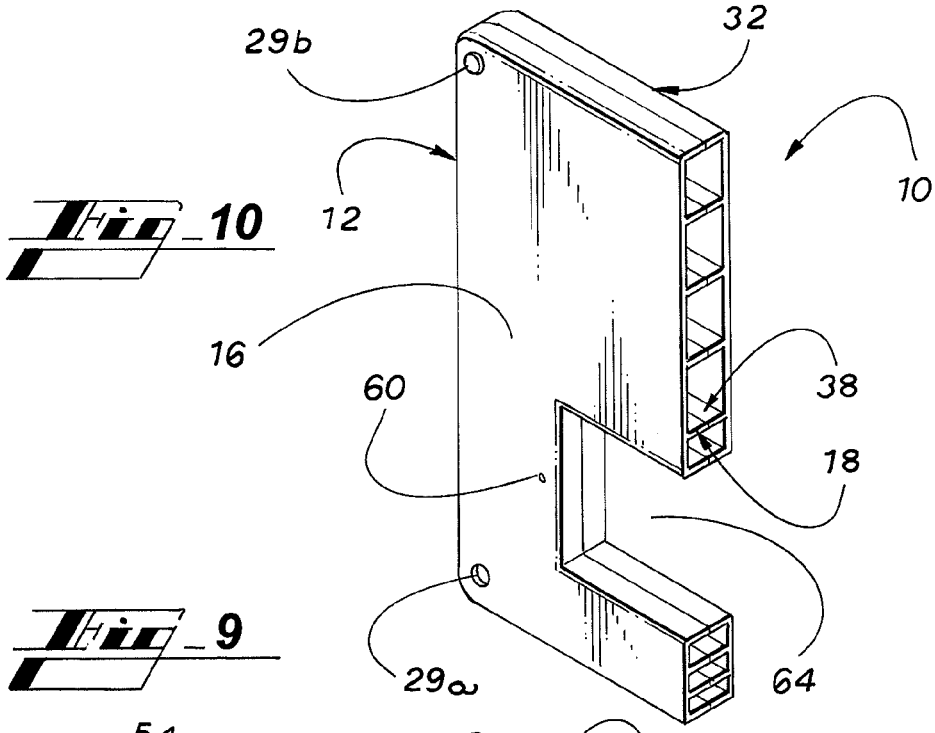
Fig_10
Fig_9
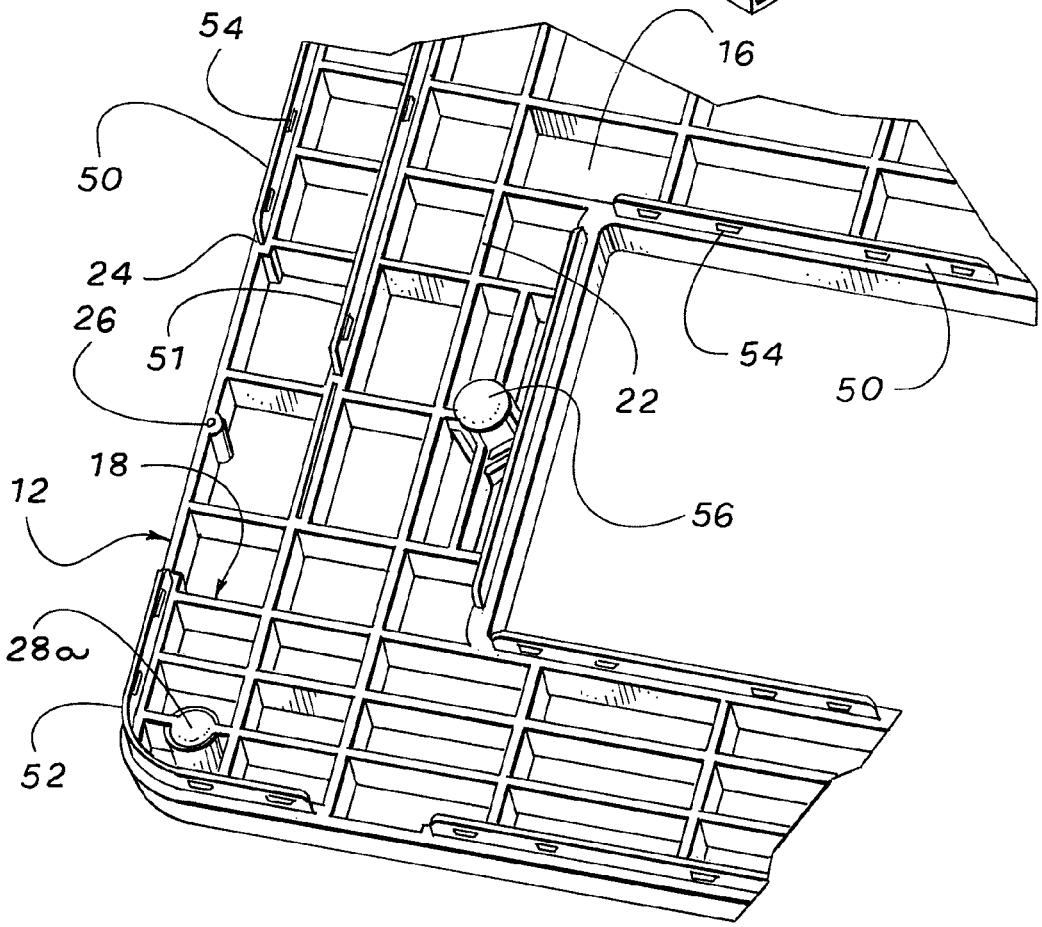

TWO-PIECE PLASTIC EQUIPMENT PAD

CROSS REFERENCE TO RELATED PATENT APPLICATIONS

This patent application claims priority from U.S. Provisional Patent Application No. 61/028,621, filed Feb. 14, 2008, which is hereby incorporated by reference.

FIELD OF THE INVENTION

This invention relates to equipment pads for supporting large pieces of equipment, such as HVAC compressors, electrical transformers, or the like on the ground.

BACKGROUND OF THE INVENTION

Traditionally, equipment pads were concrete slabs poured in place to support large pieces of equipment. Subsequently, lightweight concrete pads were pre-cast and delivered to the location for supporting the equipment. In order to save weight and cost, plastic equipment pads were developed to support the equipment. A typical plastic transformer equipment pad is disclosed in Schlegel U.S. Pat. No. 6,186,468. The transformer equipment pad disclosed in the Schlegel patent comprises a top base on which the transformer is positioned and an underlying cellular structure to provide strength for the top base. The underlying cellular structure comprises crisscrossing vertical ribs. When such an equipment pad with exposed vertical ribs is placed on the ground, the ribs provided very little flotation, and the plastic transformer pad tends to sink into the ground. Further, without a horizontal base attached to the ribs on the back of the equipment pad, the equipment pad lacks rigidity.

SUMMARY OF THE INVENTION

In order to overcome the drawbacks of the prior art plastic equipment pads, the present invention comprises a two-piece plastic equipment pad with a top portion and a bottom portion. The top portion and the bottom portion are mirror images of each other, and each has a base with an underlying grid structure comprising cells formed by perpendicular, crisscrossing ribs. In order to form the two-piece plastic equipment pad, the top portion and the bottom portion are aligned, grid structure to grid structure, and, in one embodiment, all are connected together by connector strips that frictionally engage support slots formed in the perpendicular ribs. In a second embodiment, the top portion and the bottom portion are connected together by plastic strips that are integrally formed in the ribs of either the top portion or the bottom portion and that engage matching slots in the ribs of the other portion. When the plastic strips are used, the top portion and the bottom portion with are welded together. The resulting equipment pad has a continuous top portion base and a continuous bottom portion base to support the equipment and to engage the ground respectively. Because the bottom portion has a continuous bottom portion base, the equipment pad has a large surface engaging the ground to provide flotation and to assure that the two-piece plastic equipment pad does not sink into the ground. Moreover, the presence of a top base portion and a bottom base portion with the interlocking support grids between the top base portion of the bottom based portion produces a structure that is substantially more rigid than a solid structure of the same mass or than the prior art structure with the open ribs on the bottom.

In the first embodiment, the connector strips are thin metal strips that include barbs for engaging the inside walls of the support slots. Consequently, the top portion and the bottom portion of the two-piece plastic equipment pad snap together without the need for tools or other instrumentalities. Alternatively, the connector strips and support slots could be replaced by cylindrical barbed rods circular support holes. Such barbed rods can be produced on nail or screw production equipment. The connector strips and support slots can be strategically positioned within the grid structure of the top portion and the bottom portion to reinforce the resulting two-piece plastic equipment pad in areas that experience greater loading and stresses such as around the periphery of the equipment pad. The second embodiment, the connector strips are plastic and serve to align the grids of the top portion and the bottom portion and to provide surfaces for welding of the top portion to the bottom portion.

The grid structure of the bottom portion of the two-piece plastic equipment pad includes one or more insert supports for one or more threaded inserts. Each threaded insert is exposed through a matching hole in the base of the top portion of the two-piece plastic equipment pad so that a lag bolt, can be used to connect the supported equipment to the two-piece plastic equipment pad.

The grid structures of the two-piece plastic equipment pad also include corner support posts to reinforce the corners of the pad where additional loading and stressing may occur. The corner posts also provide anchor holes at each corner of the equipment pad. A rod or similar anchor can be driven through the anchor holes to secure the equipment pad to the ground. The anchor holes may be skimmed over with a thin web of material during manufacture to seal the pad from water intrusion. The thin web can be punched out or drilled out during the installation of the anchor rods. Further, the anchor holes have mirror image embossed lips and counter bores so that when the finished pads are stacked one on the other, the lips and counter bores interlocked each other to inhibit relative sliding movement between adjacent stacked equipment pads.

Further objects, features and advantages will become apparent upon consideration of the following detailed description of the invention when taken in conjunction with the drawings and the appended claims.

BRIEF DESCRIPTION OF THE DRAWINGS

FIG. 1 is a perspective view of a two-piece plastic equipment pad in accordance with the present invention.

FIG. 2 is a top plan view of the two-piece plastic equipment pad in accordance with the present invention.

FIG. 8 is a detailed perspective view of the inside construction of the bottom portion of the two-piece plastic equipment pad in accordance with present invention.

FIG. 9 is a detailed perspective view of the inside construction of the top portion of the two-piece plastic equipment pad in accordance with present invention.

FIG. 10 is a section view of the two-piece plastic equipment pad in accordance with present invention as seen along lines 10-10 of FIG. 1.

FIG. 14 is a plan view of the inside construction of a bottom portion of a second embodiment of the two-piece plastic equipment pad in accordance with present invention.

DETAILED DESCRIPTION OF THE PREFERRED EMBODIMENT

Turning to FIG. 1, a two-piece plastic equipment pad 10 is shown. The two-piece plastic equipment pad 10 is, by way of example, a transformer pad with a cable access opening 64. The access opening 64 allows access to underground electrical cables. The two-piece plastic equipment pad 10 comprises a top portion 12 and a mirror image bottom portion 32. The top portion 12 and the bottom portion 32 are both molded from any common injection moldable, thermoformed or thermoset materials, filled or unfilled. The materials may also include materials that can be welded together to form the complete pad from the top portion 12 in the bottom portion 32. Suitable materials for the top portion 12 and the bottom portion 32 of the two-piece plastic equipment pad 10 include without limitation polypropylene, Acrylonitrile Butadiene Styrene (ABS), and styrene. Other methods besides molding may be used to produce the top portion 12 and the bottom portion 32 of the two-piece plastic equipment pad 10.

Figure 3:
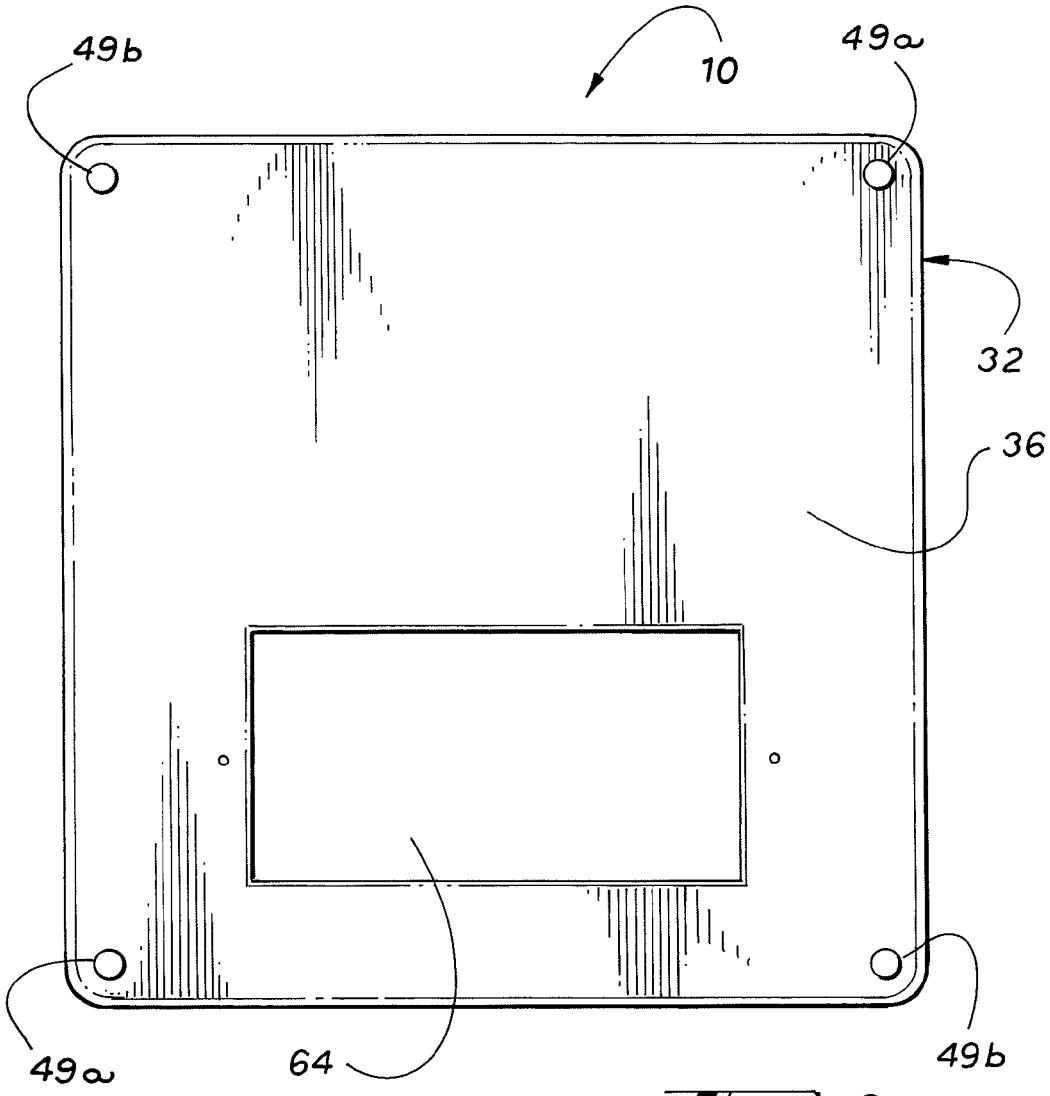
FIG. 3 is a bottom plan view of the two-piece plastic equipment pad in accordance with the present invention.
Figure 4:
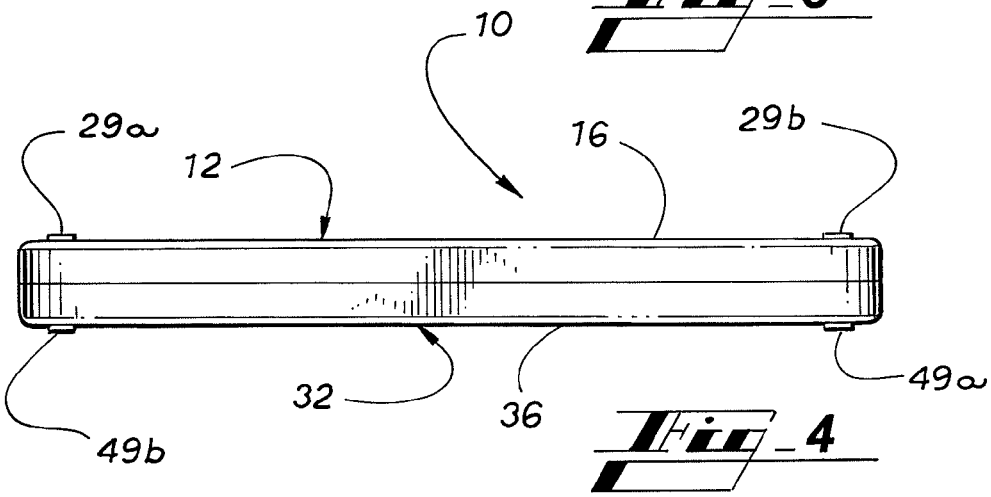
FIG. 4 is a front elevation view of the two-piece plastic equipment pad in accordance with present invention.

The top portion 12 and the bottom portion 32 are connected together as will be disclosed in greater detail below. The resulting two-piece plastic equipment pad 10, shown in FIG. 4, has a top portion base 16 and a bottom portion base 36, which are continuous except for the cable access opening 64. Consequently, the bottom portion base 36 provides a large surface area for contact with the ground and the necessary floatation to support a heavy piece of equipment resting on the top portion base 16 of the two-piece plastic equipment pad 10.

Figure 5:
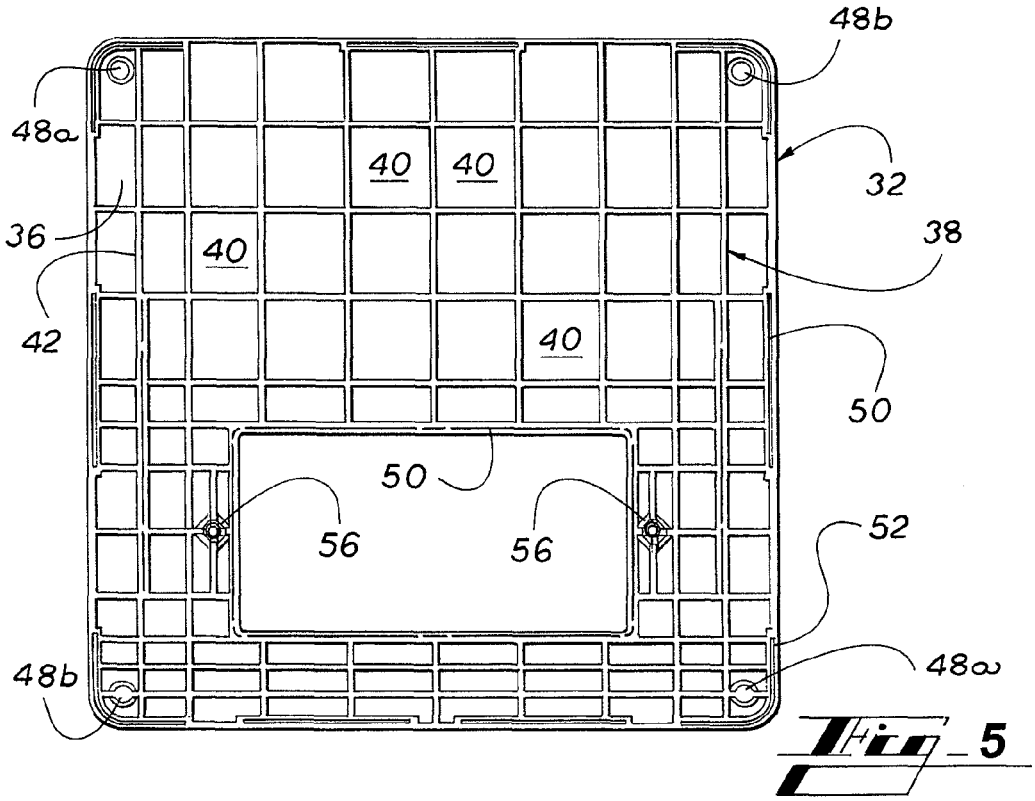
FIG. 5 is a plan view of the inside construction of the bottom portion of the two-piece plastic equipment pad in accordance with present invention.

As can best be seen in FIGS. 5 and 8, the bottom portion 32 of the two-piece plastic equipment pad 10 has an integrally formed grid structure 38 to provide rigidity to the bottom portion base 36. The grid structure 38 comprises cells 40 formed by ribs 42 extending perpendicularly from the bottom portion base 36. The ribs 42 are integrally molded with the base 36 and are sized and spaced to provide rigidity to the base 36 as required in those areas that experience loading from the equipment supported by the two-piece plastic equipment pad 10. Bottom portion corner posts 48*a* and 48*b* are formed adjacent the corners of the bottom portion 32 to provide extra support at corners of the two-piece plastic equipment pad 10.

Support slots 46 are formed in the ribs 42 around the periphery of the bottom portion 32 and in certain areas where additional stresses may exist. The support slots 46, like the ribs 42, extend perpendicular to the base portion 36. Connector strips, including straight connector strips 50 and curved connector strips 52, are inserted into the support slots 46. The stampings for the straight connector strips 50 and curved connector strips 52 are identical. The curved connector strips 52 are simply formed by bending the straight connector strips 50 into the required curved configuration. The connector strips 50 and 52 include barbs 54 that frictionally engage the inside surfaces of the support slots 46 to hold the top portion 12 and the bottom portion 32 together. The exploded view of the two-piece plastic equipment pad 10 (FIG. 7) shows how the connector strips 50 and 52 align with support slots 46 of the bottom portion 32 of the two-piece plastic equipment pad 10 and thereby align the top portion 12 on the bottom portion 32.

Figure 6:
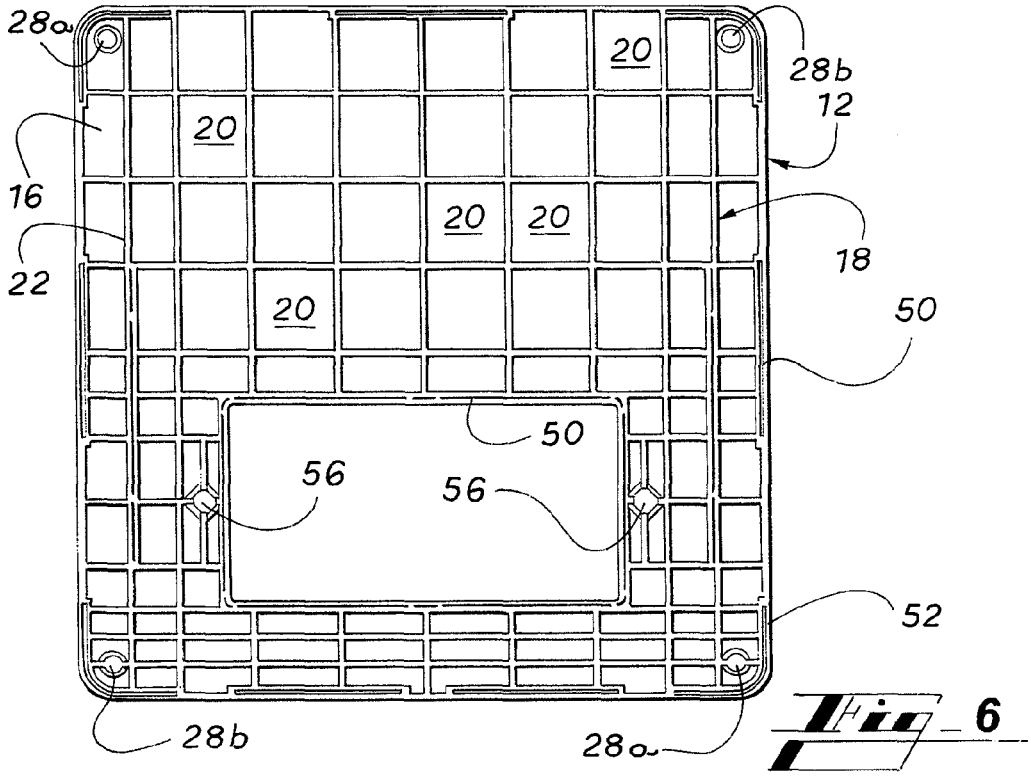
FIG. 6 is a plan view of the inside construction of the top portion of the two-piece plastic equipment pad in accordance with present invention.

As can best be seen in FIGS. 6 and 9, the top portion 12 of the two-piece plastic equipment pad 10 has an integrally formed grid structure 18 to provide rigidity to the top portion base 16. The grid structure 18 comprises cells 20 formed by ribs 22 extending perpendicularly from the top portion base 16. The ribs 22 are integrally molded with the base 16 and are sized and spaced to provide rigidity to the base 16 as required in those areas that experience loading from the equipment supported by the two-piece plastic equipment pad 10. Top portion corner posts 28*a* and 28*b* are formed adjacent the corners of the top portion 12 to provide extra support to provide extra support at corners of the two-piece plastic equipment pad 10.

Support slots 24 are formed in the ribs 22 around the periphery of the top portion 12 and in certain areas where additional stresses may exist. The support slots 24, like the ribs 22, extend perpendicular to the base portion 16. The connector strips 50 and 52 are inserted into the support slots 24. The exploded view of the two-piece plastic equipment pad 10 (FIG. 7) shows how the connector strips 50 and 52 align with support slots 24 of the top portion 12 of the two-piece plastic equipment pad 10 and thereby align the top portion 12 with the bottom portion 32.

As can be seen in FIGS. 8 and 9, the connector strips 50 and 52 are spaced around the periphery of the two-piece plastic equipment pad 10. The connector strips 50 and 52 align and connect the top portion 12 to the bottom portion 32. In addition, in a certain areas of additional stress, for example adjacent to the cable access opening 64, additional connector strips, such as connector strips 51, are used to provide additional support between the top portion 12 and the bottom portion 32.

The connector strips 50, 51, and 52 can be made from a number of common metal or plastic materials. Common cold rolled steel, galvanized, powder coated, or otherwise plated for rust, may be used. In addition, heat treatable steel, die cast zinc-aluminum alloys, extruded aluminum profiles, sawed or sheared to length, or extruded plastics may also be useful for the connector strips 50, 51, and 52. Other common materials may be used for the connector strips 50, 51, and 52 if those materials lend themselves to the formation of barbs having sufficient strength to engage the inside surfaces of the support slots 24 of the top portion 12 and the inside surfaces of the support slots 46 of the bottom portion 32. In addition, the connector strips 50, 51, and 52 and support slots 24 and 46 may be replaced by a combination of cylindrical barbed rods and circular holes. The cylindrical barbed rods may be made on nail or screw production equipment.

As best seen in FIG. 8, the bottom portion 32 of the two-piece plastic equipment pad 10 includes one or more insert support structures 58 for engaging and holding a threaded insert 56. As shown in FIG. 1, one or more access holes 60 in the top portion base 16 align with the threaded inserts 56. The threaded inserts 56 provide means for a lag bolt to attach the supported equipment to the two-piece plastic equipment pad 10.

Figure 7:
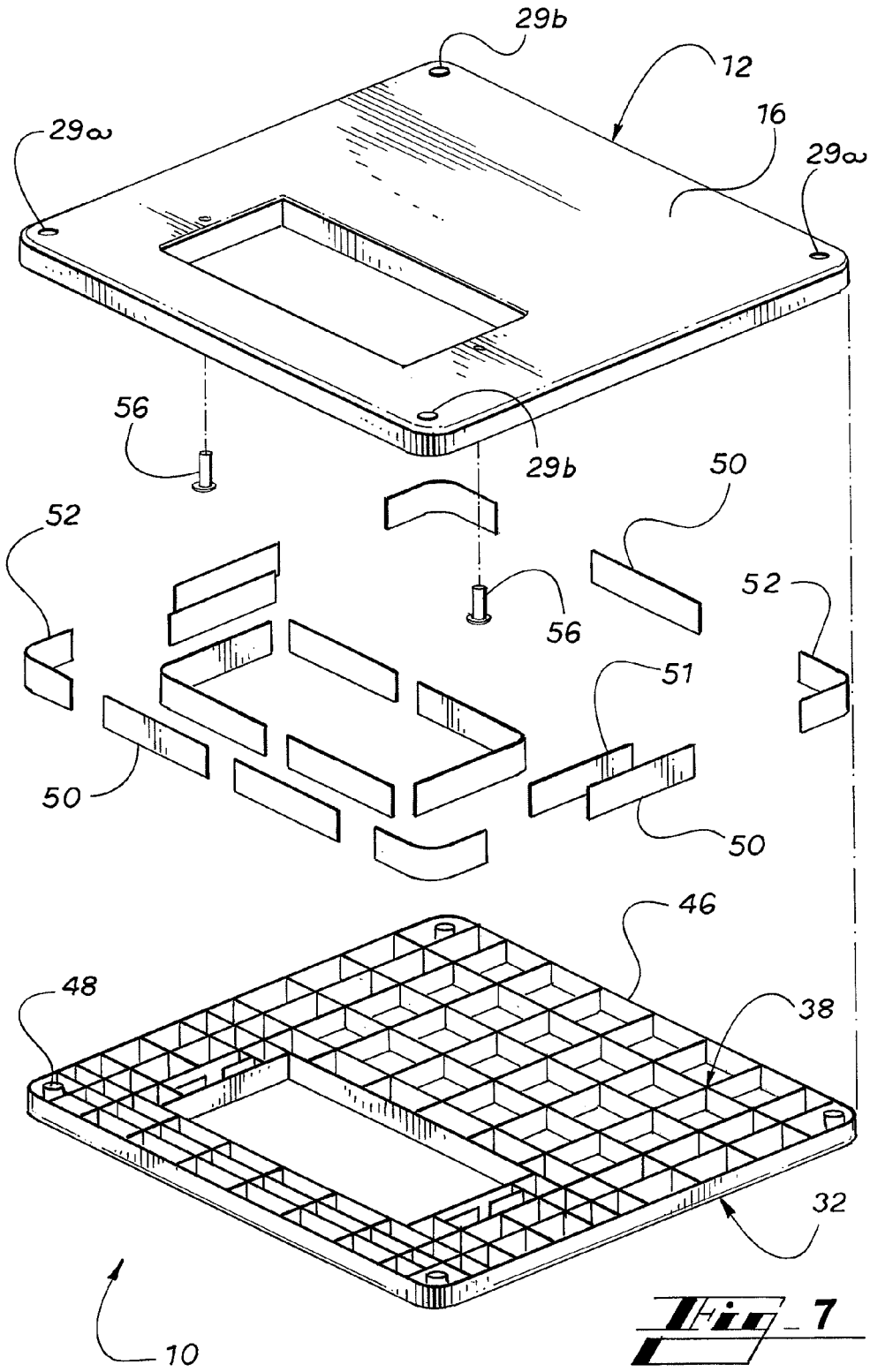
FIG. 7 is an exploded view of the two-piece plastic equipment pad with frictional connector strips in accordance with present invention.

FIG. 7 shows how the top portion 12 and the bottom portion 32 are assembled together using the connector strips 50, 51, and 52 to construct the finished two-piece plastic equipment pad 10. Particularly, the connector strips 50, 51, and 52 are inserted into the support slots 46 of the bottom portion 32. The top portion 12 is then lowered onto the connector strips 50, 51, and 52 so that the support slots 24 at the top portion 12 engage the connector strips 50, 51, and 52. In addition, guide-posts 44 (FIG. 8) around the periphery of the bottom portion 32 align with and engage guide holes 26 (FIG. 9) around the periphery of the top portion 12. As seen in FIG. 10, the grid structure 18 of the top portion 12 and the grid structure 38 of the bottom portion 32 align with each other to provide a continuous cellular support structure between the base 16 of the top portion 12 and the base the 36 of the bottom portion 32 of the two-piece plastic equipment pad 10.

Figure 13:
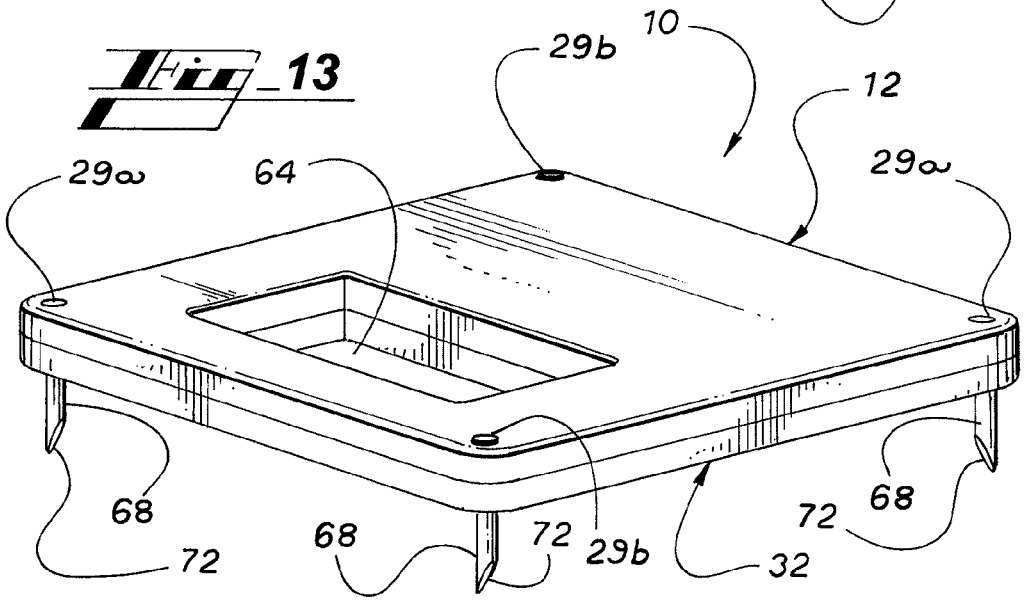
FIG. 13 is a detailed perspective view of the corner of the two-piece plastic equipment pad in accordance with the present invention.

In addition to providing structural integrity, the corner posts 28*a*, 28*b*, 48*a*, and 48*b* with anchor holes 29*a*, 29*b*, 49*a*, and 49*b* respectively serve two other purposes. First, the anchor holes 29*a*, 29*b*, 49*a*, and 49*b* accommodate round anchors, such as PVC tubing, rebar, etc., driven into the ground to secure the two-piece plastic equipment pad 10 in place. The anchor holes 29*a*, 29*b*, 49*a*, and 49*b* may be molded with a thin web to inhibit entry of moisture into the equipment pad 10. Once the equipment pad 10 has been delivered to the construction site, the thin web can be punched out or drill out to accommodate the round anchors. FIG. 13 illustrates the use of a PVC pipe as a stake 68 to inhibit lateral movement of the equipment pad 10 once it has been positioned on the ground. Particularly, the stake 68 has its first end inserted into each of the four bottom portion anchor holes 49 in the bottom portion 32 of the equipment pad 10. Bottom portion anchor holes 49 align with top portion anchor holes 29. A first end of the stake 68 extends through the bottom portion anchor hole 49*a* into the top portion anchor hole 29*a* where the stake 68 abuts an annular shoulder 74 (FIG. 11) in the top portion anchor hole 29*a*. Therefore, the stake 68 cannot extend completely through the top portion anchor hole 29*a*. A second end 72 of the stake 68 is then cut at an angle to create a sharpened point. With the stakes 68 positioned within anchor holes 49 and 29 at all four corners of the equipment pad 10, the stakes are driven into the ground by introducing weight (such as by the weight of the installer) onto the top portion 12 of the equipment pad 10.

Figure 11:
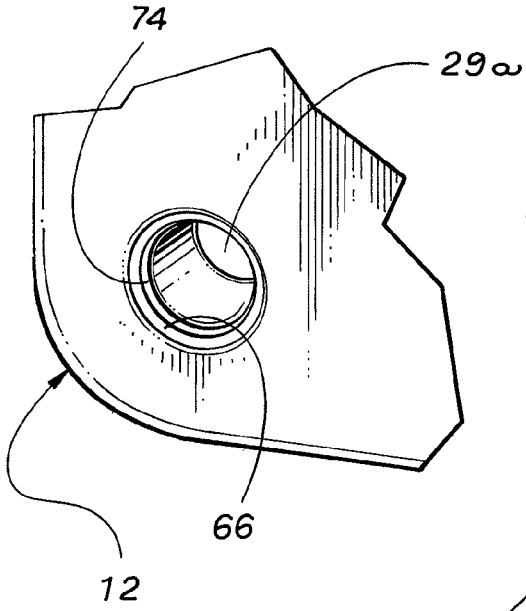
FIG. 11 is a detailed perspective view of the outside construction of one of the anchor holes of the top portion of the two-piece plastic equipment pad in accordance with present invention.
Figure 12:
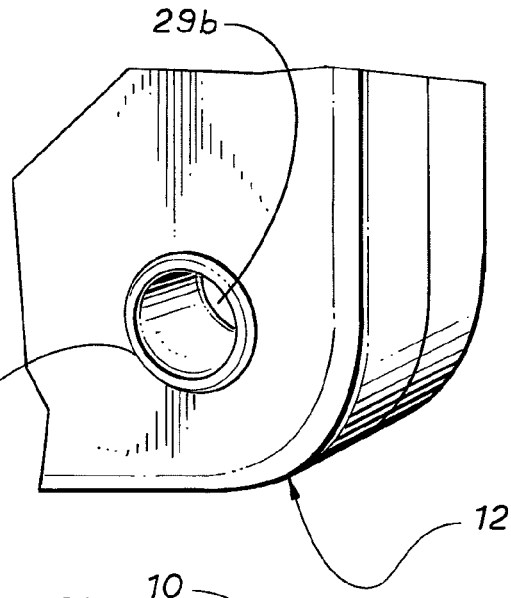
FIG. 12 is a detailed perspective view of the outside construction of another of the anchor holes of the top portion of the two-piece plastic equipment pad in accordance with present invention.

Second, each of the anchor holes 29*b* and 49*b* has a concentric extending lip 62 (FIG. 12), and each of the anchor holes 29*a* and 49*a* has a concentric counter bore 66 (FIG. 11). When the equipment pads 10 are stacked, one on top of the other, to form a shippable unit on a pallet, the concentric extending lip 62 on one equipment pad 10 engages the concentric counter bore 66 on the adjacent stacked equipment pad 10. The engagement between the concentric extending lip 62 and the concentric counter bore 66 inhibits sliding between the adjacent stacked equipment pads 10 during shipment.

Figure 15:
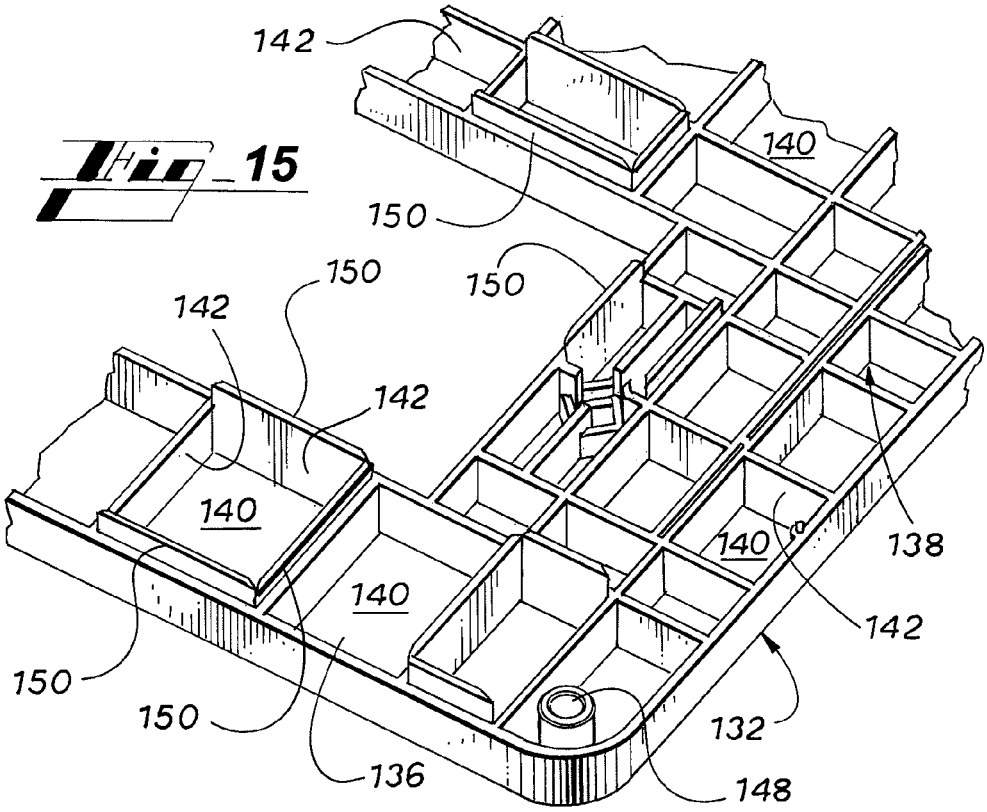
FIG. 15 is a detailed perspective view of the inside construction of the bottom portion of the second embodiment of the two-piece plastic equipment pad in accordance with present invention.
Figure 16:
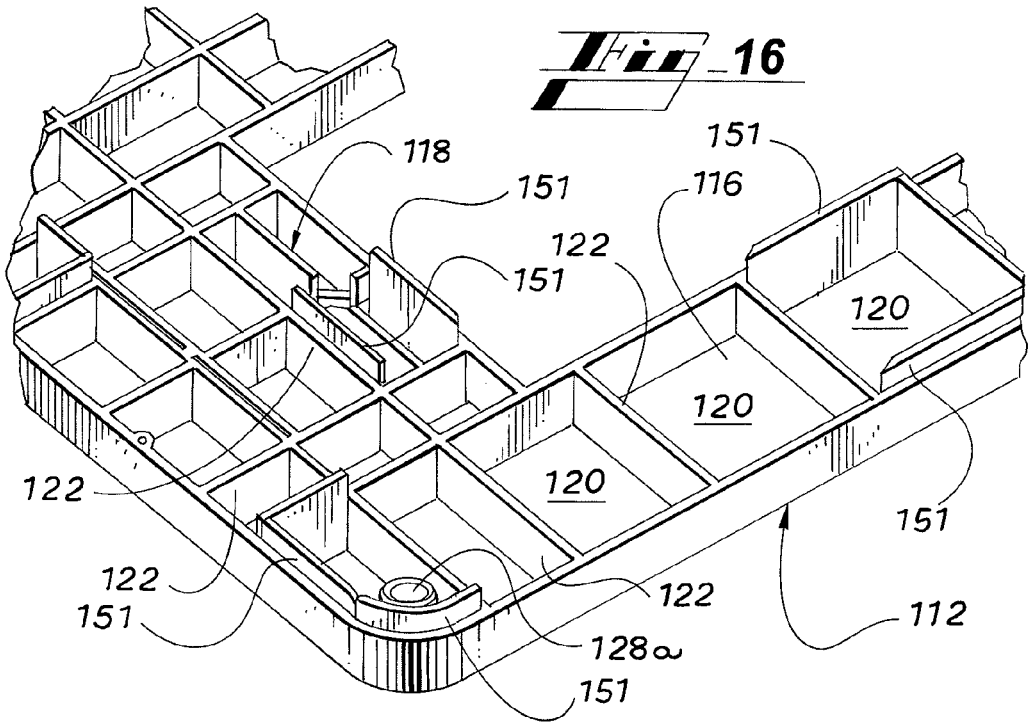
FIG. 16 is a detailed perspective view of the inside construction of the top portion of the second embodiment of the two-piece plastic equipment pad in accordance with present invention.

Turning to FIGS. 14-16, a second embodiment of the equipment pad 10 comprises a modified top portion 112 (FIG. 16) with an internal top portion grid structure 118 and a modified bottom portion 132 (FIGS. 14 and 15) with an internal bottom portion grid structure 138. The modified top portion 112 is identical to the modified bottom portion 132. The second embodiment of the equipment pad 10 is constructed by orienting the top portion grid structure of the modified top portion and the bottom portion grid structure of the modified bottom portion 132 in face-to-face relationship and joining the two portions together.

As shown in FIGS. 14 and 15, the modified bottom portion 132 of the two-piece plastic equipment pad 10 has an integrally formed bottom portion grid structure 138 to provide rigidity to the bottom portion base 136. The bottom portion grid structure 138 comprises cells 140 formed by bottom portion ribs 142 extending perpendicularly from the bottom portion base 136. The bottom portion ribs 142 are integrally molded with the bottom portion base 136 and are sized and spaced to provide rigidity to the bottom portion base 136 as required in those areas that experience loading from the equipment supported by the two-piece plastic equipment pad 10. Bottom portion corner posts 148*a* and 148*b* are formed adjacent the corners of the bottom portion 132 to provide extra support at corners of the two-piece plastic equipment pad 10.

As shown in FIG. 16, the modified top portion 112 of the two-piece plastic equipment pad 10 has an integrally formed top portion grid structure 118 to provide rigidity to the top portion base 116. The top portion grid structure 118 comprises cells 120 formed by top portion ribs 122 extending perpendicularly from the top portion base 116. The top portion ribs 122 are integrally molded with the top portion base 116 and are sized and spaced to provide rigidity to the top portion base 116 as required in those areas that experience loading from the equipment supported by the two-piece plastic equipment pad 10. Top portion corner posts, such as top portion corner post 128*a*, are formed adjacent the corners of the bottom portion 112 to provide extra support at corners of the two-piece plastic equipment pad 10.

Bottom connector strips 150 (FIG. 15) are integrally formed with and protrude from the bottom portion ribs 142 in preselected areas where stresses may exist. Similarly, top connector strips 151 (FIG. 16) are integrally formed with and protrude from the top portion ribs 122 in preselected areas where stresses may exist. The bottom connector strips 150, like the bottom portion ribs 142, and the top connector strips 151, like the top portion ribs 122, extend perpendicular to the bottom portion base 136 and the top portion base 116 respectively. The bottom connector strips 150 are sized and positioned along the edges of the bottom portion ribs 142 to engage the sides of the top portion ribs 122 (FIG. 16) when the top portion 112 and the bottom portion 132 are oriented with the top portion grid structure 118 and the bottom portion grid structure 138 in face-to-face relationship. Likewise, The top connector strips 151 are sized and positioned along the edges of the top portion ribs 122 to engage the sides of the bottom portion ribs 142 (FIG. 15) when the top portion 112 and the bottom portion 132 are oriented with the top portion grid structure 118 and the bottom portion grid structure 138 in face-to-face relationship. The bottom connector strips 150 and the top connector strips 151, when engaged with the top portion ribs 122 and the bottom portion ribs at 142 respectively, align the top portion ribs 122 with the bottom portion ribs 142. The top portion ribs 122 and the bottom portion ribs 142 are then welded together so that the top portion 112 and the bottom portion 132 are connected together. Welding may be accomplished by any means known to those of ordinary skill in the art including without limitation solvent welding, hot-air welding, and sonic welding.

While this invention has been described with reference to preferred embodiments thereof, it is to be understood that variations and modifications can be affected within the spirit and scope of the invention as described herein and as described in the appended claims.

We claim:

1. A two-piece equipment pad comprising:

a. a top portion comprising a top portion base with a top portion grid structure comprising a plurality of upstanding top portion ribs protruding from the top portion base; and b. a bottom portion comprising a bottom portion base with a bottom portion grid structure comprising a plurality of upstanding bottom portion ribs protruding from the bottom portion base, wherein the top portion is connected to the bottom portion so that the top portion grid structure and the bottom portion grid structure are oriented face-to-face, and the top portion ribs and the bottom portion ribs align with each other and wherein the top portion ribs have top portion slots, the bottom portion ribs have bottom portion slots, and connector strips engage the top portion slots and the bottom portion slots to hold the top portion and the bottom portion aligned.

2. The two-piece equipment pad of claim 1, wherein the top portion and the bottom portion are identical in construction.

3. The two-piece equipment pad of claim 1, wherein the bottom portion has a bottom portion periphery with guideposts spaced around the bottom portion periphery and the top portion has a top portion periphery with guide holes spaced around the top portion periphery, wherein the guideposts and the guide holes align and engage with each other in order to align the top portion with the bottom portion.

4. The two-piece equipment pad of claim 1, wherein the bottom portion has a bottom portion periphery with guide holes spaced around the bottom portion periphery and the top portion has a top portion periphery with guideposts spaced around the top portion periphery, wherein the guide holes and the guideposts align and engage with each other in order to align the top portion with the bottom portion.

5. A two-piece equipment pad comprising:

a. a top portion comprising a top portion base with a top portion grid structure comprising a plurality of upstanding top portion ribs protruding from the top portion base; and b. a bottom portion comprising a bottom portion base with a bottom portion grid structure comprising a plurality of upstanding bottom portion ribs protruding from the bottom portion base, wherein the top portion is connected to the bottom portion so that the top portion grid structure and the bottom portion grid structure are oriented face-to-face, and the top portion ribs and the bottom portion ribs align with each other and wherein the top portion ribs have top portion holes, the bottom portion ribs have bottom portion holes, and connector rods engage the top portion holes and the bottom portion holes to hold the top portion and the bottom portion aligned.

6. The two-piece equipment pad of claim 5, wherein the top portion and the bottom portion are identical in construction.

7. The two-piece equipment pad of claim 5, wherein the bottom portion has a bottom portion periphery with guideposts spaced around the bottom portion periphery and the top portion has a top portion periphery with guide holes spaced around the top portion periphery, wherein the guideposts and the guide holes align and engage with each other in order to align the top portion with the bottom portion.

8. The two-piece equipment pad of claim 5, wherein the bottom portion has a bottom portion periphery with guide holes spaced around the bottom portion periphery and the top portion has a top portion periphery with guideposts spaced around the top portion periphery, wherein the guide holes and the guideposts align and engage with each other in order to align the top portion with the bottom portion.

9. A two-piece equipment pad comprising:

a. a top portion comprising a top portion base with a top portion grid structure comprising a plurality of upstanding top portion ribs protruding from the top portion base; and b. a bottom portion comprising a bottom portion base with a bottom portion grid structure comprising a plurality of upstanding bottom portion ribs protruding from the bottom portion base, wherein the top portion is connected to the bottom portion so that the top portion grid structure and the bottom portion grid structure are oriented face-to-face, and the top portion ribs and the bottom portion ribs align with each other and wherein the top portion ribs and the bottom portion ribs have integrally formed connector strips, and the connector strips engage the top portion ribs and the bottom portion ribs to hold the top portion and the bottom portion aligned.

10. The two-piece equipment pad of claim 9, wherein the top portion and the bottom portion are identical in construction.

11. The two-piece equipment pad of claim 9, wherein the bottom portion has a bottom portion periphery with guideposts spaced around the bottom portion periphery and the top portion has a top portion periphery with guide holes spaced around the top portion periphery, wherein the guideposts and the guide holes align and engage with each other in order to align the top portion with the bottom portion.

12. The two-piece equipment pad of claim 9, wherein the bottom portion has a bottom portion periphery with guide holes spaced around the bottom portion periphery and the top portion has a top portion periphery with guideposts spaced around the top portion periphery, wherein the guide holes and the guideposts align and engage with each other in order to align the top portion with the bottom portion.

13. A two-piece equipment pad comprising:

a. a top portion comprising a top portion base with a top portion grid structure comprising a plurality of upstanding top portion ribs protruding from the top portion base; and b. a bottom portion comprising a bottom portion base with a bottom portion grid structure comprising a plurality of upstanding bottom portion ribs protruding from the bottom portion base, wherein the top portion is connected to the bottom portion so that the top portion grid structure and the bottom portion grid structure are oriented face-to-face, and the top portion ribs and the bottom portion ribs align with each other and wherein the bottom portion includes a support structure for engaging and holding a female threaded insert that extends upwardly and the top portion includes a hole aligned with the female threaded insert.

14. A two-piece equipment pad comprising:

a. a top portion comprising a top portion base with a top portion grid structure comprising a plurality of upstanding top portion ribs protruding from the top portion base; and b. a bottom portion comprising a bottom portion base with a bottom portion grid structure comprising a plurality of upstanding bottom portion ribs protruding from the bottom portion base, wherein the top portion is connected to the bottom portion so that the top portion grid structure and the bottom portion grid structure are oriented face-to-face, and the top portion ribs and the bottom portion ribs align with each other, wherein the top portion has a top portion anchor hole and the bottom portion has a bottom portion anchor hole, wherein the top portion anchor hole and the bottom portion anchor hole align with each other to form a pad anchor hole when the top portion is connected to the bottom portion, and wherein a thin web covers the pad anchor hole.

15. A two-piece equipment pad comprising:

a. a top portion comprising a top portion base with a top portion grid structure comprising a plurality of upstanding top portion ribs protruding from the top portion base; and b. a bottom portion comprising a bottom portion base with a bottom portion grid structure comprising a plurality of upstanding bottom portion ribs protruding from the bottom portion base, wherein the top portion is connected to the bottom portion so that the top portion grid structure and the bottom portion grid structure are oriented face-to-face, and the top portion ribs and the bottom portion ribs align with each other, wherein the top portion has a top portion anchor hole and the bottom portion has a bottom portion anchor hole, wherein the top portion anchor hole and the bottom portion anchor hole align with each other to form a pad anchor hole when the top portion is connected to the bottom portion, and wherein the pad anchor hole has an extending lip on one side and a concentric counter bore on the other side.

16. A two-piece equipment pad comprising:

a. a top portion comprising a top portion base with a top portion grid structure comprising a plurality of upstanding top portion ribs protruding from the top portion base; and b. a bottom portion comprising a bottom portion base with a bottom portion grid structure comprising a plurality of upstanding bottom portion ribs protruding from the bottom portion base, wherein the top portion is connected to the bottom portion so that the top portion grid structure and the bottom portion grid structure are oriented face-to-face, and the top portion ribs and the bottom portion ribs align with each other, wherein the top portion has a top portion anchor hole and the bottom portion has a bottom portion anchor hole, wherein the top portion anchor hole and the bottom portion anchor hole align with each other to form a pad anchor hole when the top portion is connected to the bottom portion, and wherein the pad anchor hole has an annular shoulder within the anchor hole to engage an anchoring stake.

* * * * *